US006385893B1

(12) United States Patent
Cheng

(10) Patent No.: US 6,385,893 B1
(45) Date of Patent: May 14, 2002

(54) MOUNTING DEVICE OF PISTOL LASER SIGHT

(76) Inventor: Chung-Tien Cheng, 340 Dewpoint La., Alpharetta, GA (US) 30022

( * ) Notice: Subject to any disclaimer, the term of this patent is extended or adjusted under 35 U.S.C. 154(b) by 43 days.

(21) Appl. No.: 09/635,000

(22) Filed: Aug. 8, 2000

(51) Int. Cl.[7] ..... F41G 1/34
(52) U.S. Cl. ..... 42/124; 42/146
(58) Field of Search ..... 42/124

(56) References Cited

U.S. PATENT DOCUMENTS 4,777,754 A * 10/1988 Reyolds, Jr. ..... 42/103
5,107,612 A * 4/1992 Bechtel ..... 42/103
5,282,594 A 2/1994 Huang ..... 248/205.1
5,351,429 A * 10/1994 Ford ..... 42/103
5,581,898 A * 12/1996 Thummel ..... 33/241
5,590,486 A * 1/1997 Moore ..... 42/103
5,621,999 A * 4/1997 Moore ..... 42/103
5,671,559 A * 9/1997 Ludaesher et al. ..... 42/1.08
5,706,600 A * 1/1998 Toole et al. ..... 42/103
5,758,444 A 6/1998 Ruger et al. ..... 42/16
5,758,448 A 6/1998 Thummel ..... 42/103
6,185,854 B1 * 2/2001 Solinsky et al. ..... 42/103

* cited by examiner

*Primary Examiner*—Michael J. Carone
*Assistant Examiner*—Denise J Buckley
(74) *Attorney, Agent, or Firm*—Browdy and Neimark, P.L.L.C.

(57) ABSTRACT

A pistol laser sight mounting device comprises a base, a base cover, an L-shaped rod, and a receiving member. The base is provided with a retaining slot for disposing a pistol trigger guard, and with a first fastening portion having an arcuate surface. The base cover is fastened with the base such that the retaining slot is sealed off by the base cover. The L-shaped rod has a fixed arm and a suspension arm. The fixed arm is provided with a second fastening portion which is fastened with the first fastening portion of the base. The receiving member is provided with two arm portions and a receiving through hole for holding the pistol laser sight. The receiving member is fastened with the L-shaped rod by the two arm portions which are fastened with the suspension arm of the L-shaped rod.

12 Claims, 5 Drawing Sheets

MOUNTING DEVICE OF PISTOL LASER SIGHT

FIELD OF THE INVENTION

The present invention relates generally to a pistol accessory, and more particularly to a mounting device of a pistol laser sight.

BACKGROUND OF THE INVENTION

The U.S. Pat. No. 5,282,594 discloses a pistol sight mounting device which is located on an L-shaped rod comprising two arms. One of the two arms is provided with a retaining slot for disposing a pistol trigger guard. The retaining slot is sealed off by a cover plate which is fastened securely with the arm. Other one of the two arms of the L-shaped rod is provided with a cylindrical body fastened therewith for disposing the pistol laser sight mounting device.

Such a prior art disclosure as described above has several drawbacks. In the first place, the L-shaped rod of the disclosure is not compatible with the pistol trigger guards of various specifications. In other words, the prior art disclosure is not cost-effective in light of the production, the marketing, the inventory, and the display of the L-shaped rods of various specifications. In addition, the cylindrical body of the prior art disclosure is provided at the front end with a relatively small C-shaped circular section for fastening the laser sight in conjunction with a fastening bolt. In view of the relatively small fastening area that is available for mounting the laser sight, it is conceivable that the laser sight is susceptible to deflection which is caused by the firing vibrations of the pistol. The deflection of the laser sight undermines the sighting precision.

The U.S. Pat. No. 5,758,448 discloses a general-purpose base suitable for use in pistols of various types. This disclosure provides a solution to the problems of the preceding disclosure; nevertheless it is by no mean s free from the deficiency. The base is provided with a dovetail rail for fastening a laser sight by means of a dovetail slot adjustable in width, and a bolt for fastening a clamping piece which is located at the side of the dovetail slot. The clamping piece is vulnerable to becoming loosened by the firing impact of the pistol, thereby resulting in deflection of the laser sight.

SUMMARY OF THE INVENTION

The primary objective of the present invention is to provide a general-purpose mounting device of the pistol laser sight. The mounting device of the present invention is suitable for use in pistols of various types and is simple in construction. The mounting device of the present invention is free from the shortcomings of the prior art devices described above.

In keeping with the principle of the present invention, the foregoing objective of the present invention is attained by the pistol laser sight mounting device comprising a base, a base cover, an L-shaped rod, and a receiving member. The base is provided with a retaining slot for disposing a pistol trigger guard and is further provided with a fastening portion facing the muzzle and having an arcuate surface. The base cover is fastened with the side of the base by butt joint. The L-shaped rod has a fixed arm and a suspension arm. The fixed arm is provided with a fastening portion complementary in shape to the fastening portion of the base. The two fastening portions can be adjustably joined together by butt joint so as to enable the L-shaped rod and the base to be fastened together with precision by virtue of the arcuate surface of the base. The L-shaped rod is not vulnerable to deflection caused by the firing vibration of the pistol. The receiving member has a receiving hole which is provided in the hole wall thereof with a notch extending along the longitudinal direction of the receiving hole. There are two arm portions opposite to each other and extending outward from two sides of the indentation. The receiving hole is intended to hold a laser sight. In the meantime, the two arm portions are fastened with the suspension arm of the L-shaped rod. The laser sight is securely held by the hole wall of the receiving hole of the receiving member.

The foregoing objective, features, functions, and advantages of the present invention will be more readily understood upon a thoughtful deliberation of the following detailed description of a preferred embodiment of the present invention will reference to the accompanying drawings.

DETAILED DESCRIPTION OF THE INVENTION

Figure 1:
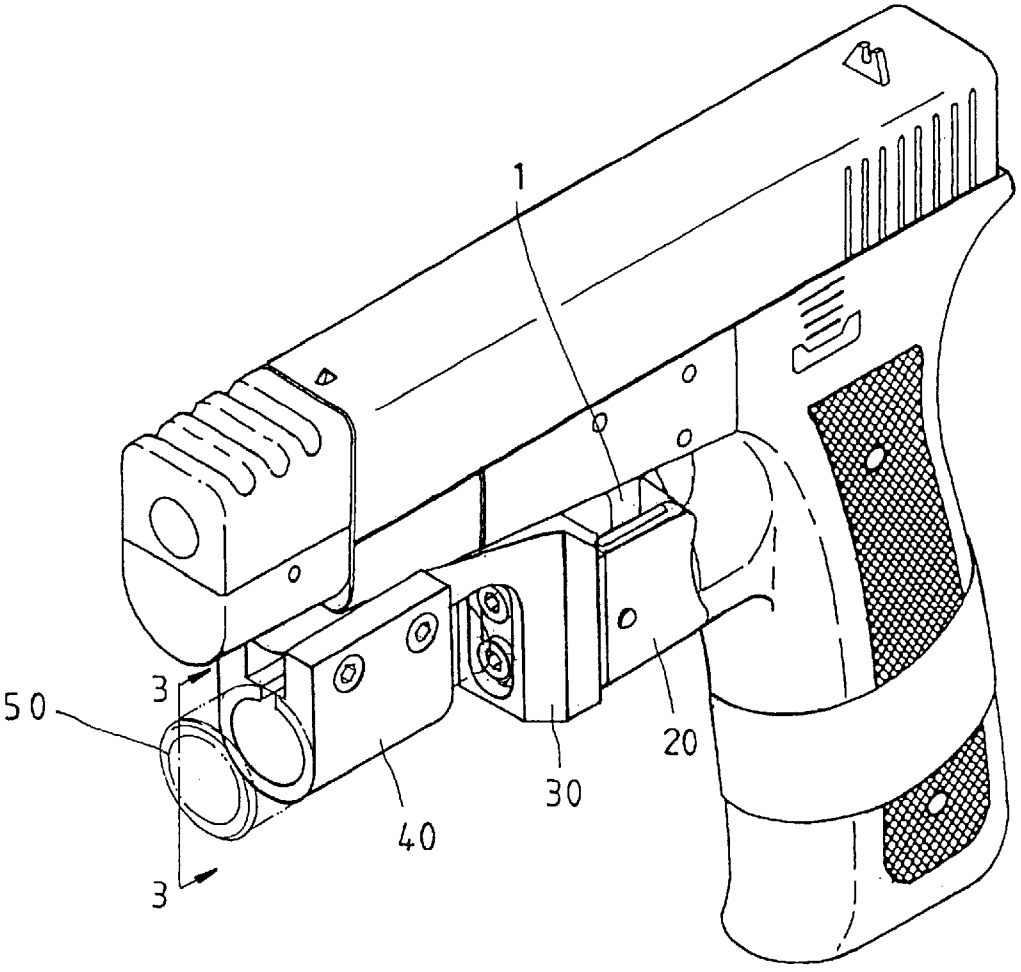
FIG. 1 shows a schematic view of the preferred embodiment of the present invention in use.
Figure 2:
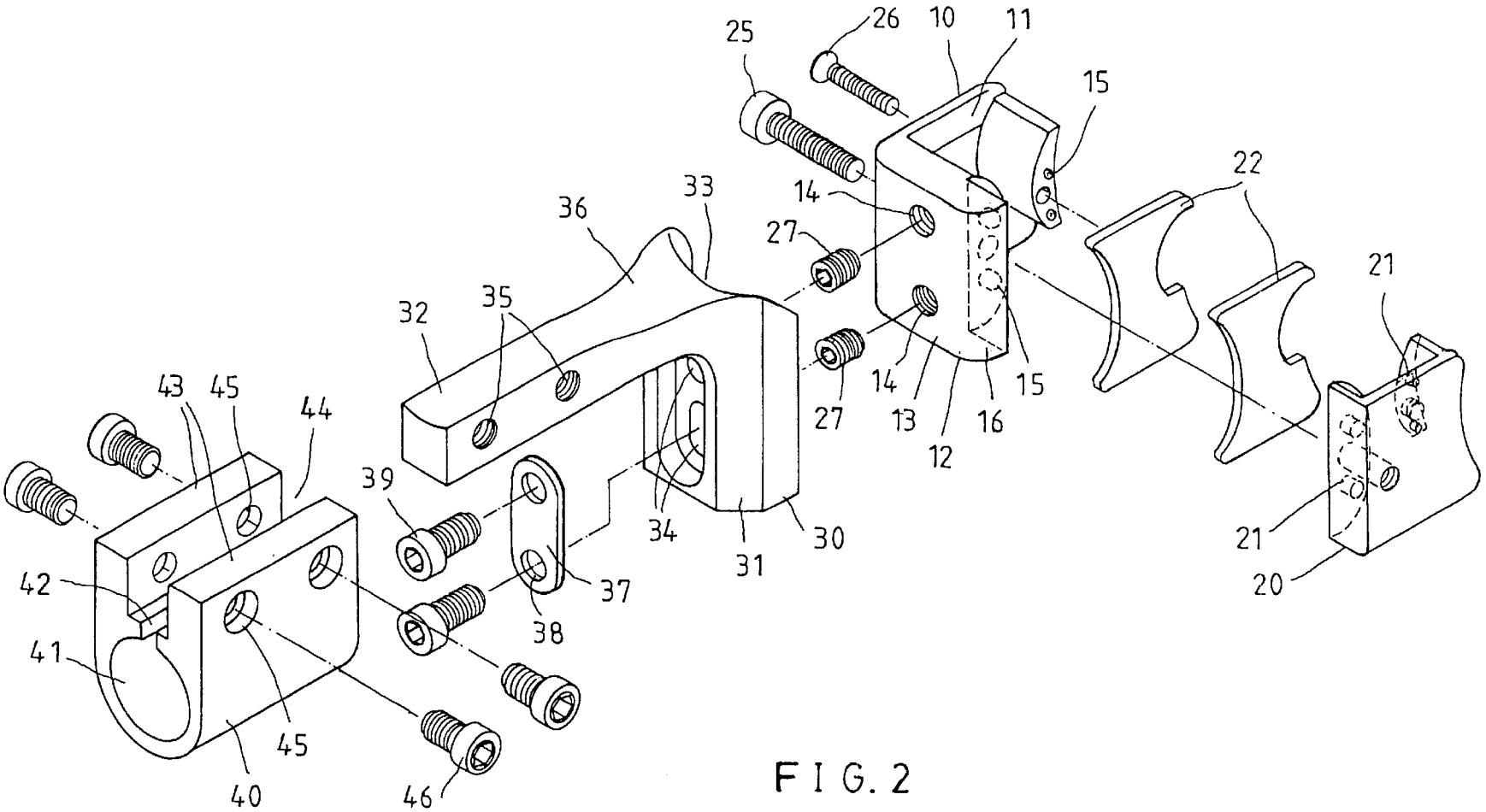
FIG. 2 shows an exploded view of the preferred embodiment of the present invention.
Figure 3:
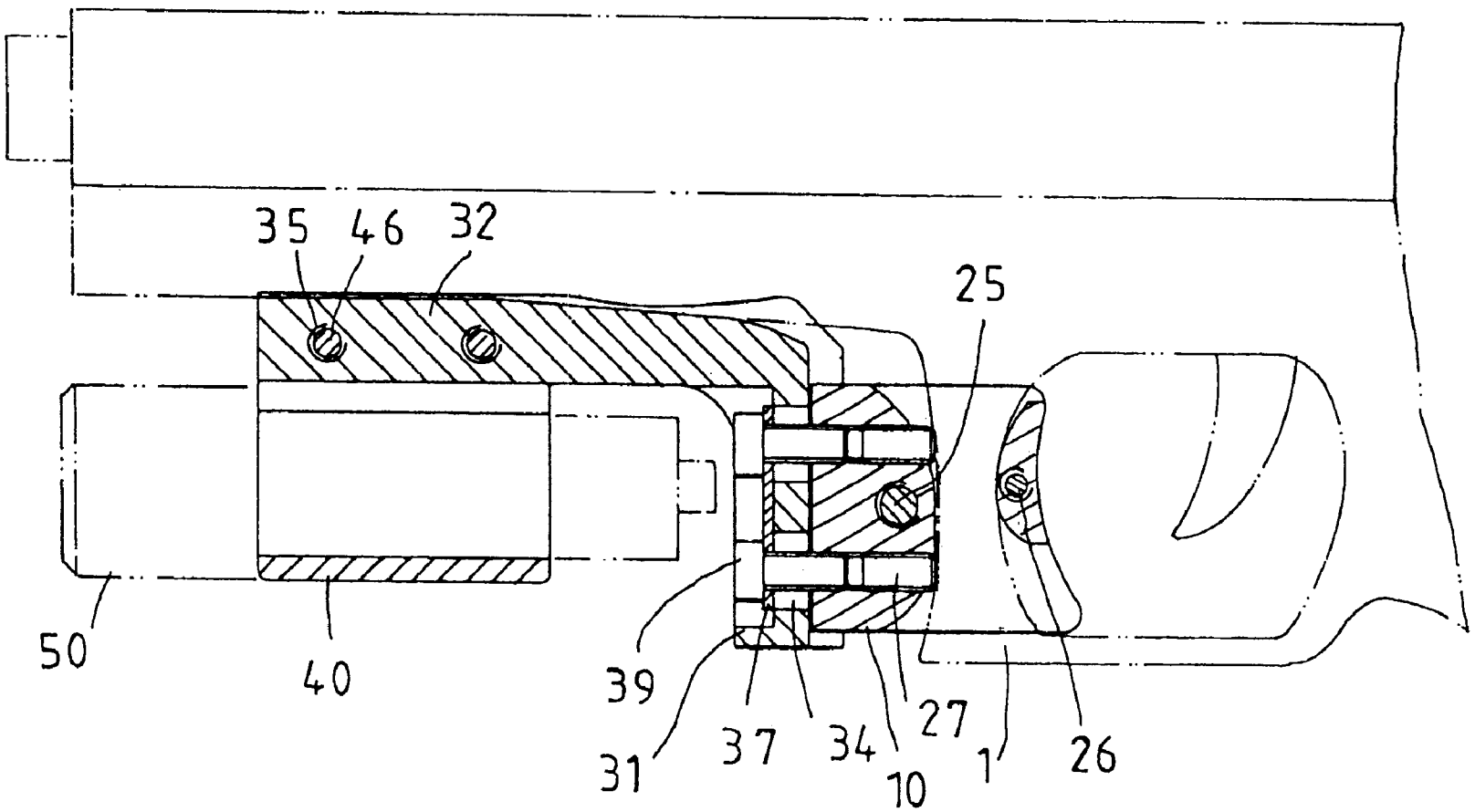
FIG. 3 shows a sectional view of a portion taken along the direction indicated by a line 3—3 as shown in FIG. 1.

As shown in FIGS. 1–3, a pistol laser sight mounting device of the preferred embodiment of the present invention comprises the component parts which are described explicitly hereinafter.

A base 10 has a retaining slot 11 for disposing a pistol trigger guard 1. The base 10 is provided with a first fastening portion 12 facing the pistol muzzle. The first fastening portion 12 is provided at a front end surface 13 thereof with two threaded holes 14 in communication with the retaining slot 11. The base 10 is provided with a plurality of protrusions 15.

A base cover 20 is joined with the side of the base 10 by butt joint for sealing off the retaining slot 11. The base cover 20 is provided with a plurality of retaining cavities 21 corresponding in location to the protrusions 15 of the base 10. The base cover 20 is joined with the base 10 such that the protrusions 15 are retained in the retaining cavities 21.

Two pads 22 are retained in the retaining slot 11 of the base 10 for adjusting the depth of the retaining slot 11, so as to enable the base 10 and the base cover 20 to hold securely the pistol trigger guard 1. The pads 22 may not be required for pistols of certain types.

The fastening bolts 25 and 26 are disposed at the front and the rear sides of the retaining slot 11 for fastening detachably the base 10 and the base cover 20 with the pistol trigger guard 1.

The adjusting screws 27 are respectively engaged in the threaded holes 14 of the base 10 for use in tightening the base 10 and adjusting the angle between the base 10 and the pistol trigger guard 1.

The component parts described above are basically similar to those of the disclosure of the U.S. Pat. No. 5,758,448, with the difference being that the first fastening portion 12 of the base 10 is of an arcuate construction instead of the dovetail construction, and that the first fastening portion 12 is provided at the front end thereof with a planar surface 13 which is in turn provided in the left side thereof and the right said thereof with an arcuate surface 16.

An L-shaped rod 30 has a fixed arm 31 and a suspension arm 32. The fixed arm is provided with a second fastening portion 33, which is fastened with the first fastening portion 12 of the base 10 by butt joint. The second fastening portion 33 is provided with two long holes 34 extending along the longitudinal direction of the fixed arm 31. The suspension arm 32 is provided with two threaded holes 35 and is further provided in the top surface thereof with a depression 36 which becomes progressively deeper in the direction toward the fixed arm 31.

A padding piece 37 is provided with two through holes 38 and is fastened with the outer side of the fixed arm 31 by two fastening bolts 39, which are engaged with the two threaded holes 14 of the base 10 via the two through holes 38 of the padding piece 37 and the two long holes 34 of the second fastening portion 33 of the fixed arm 31. The suspension arm 32 can be adjusted in position by means of the long holes 34 in accordance with shape and size of the pistol barrel. The suspension arm 32 is securely attached to the underside of the pistol barrel by means of the depression 36 such that the suspension arm 32 is not deflected by the impact force which is brought about at the time when the projectile is fired through the pistol barrel. The L-shaped rod 30 and the base 10 can be fastened together with precision in view of the second fastening portion 33 of the L-shaped rod 30 being guided by the arcuate surface of the first fastening portion 12 of the base 10.

A receiving member 40 has a receiving through hole 41, which is provided in the wall thereof with a notch 42 extending along the longitudinal direction of the through hole 41 for enabling the through hole 41 to have various inner diameters. The receiving through hole 41 is used to receive a laser sight 50 as indicated by the imaginary lines in FIG. 1. The receiving member 40 is further provided with two arm portions 43 opposite to each other and extending outward from two sides of the notch 42, and with a receiving slot 44 located between the two arm portions 43 for receiving the suspension arm 32 of the L-shaped rod 30. The two arm portions 43 are provided with two fastening through holes 45 corresponding in location to the threaded holes 35 of the suspension arm 32. The laser sight 50 is securely held in the receiving through hole 41 of the receiving member 40 by four bolts 46 which are engaged with the threaded holes 35 of the suspension arm 32 via the fastening through holes 45 of the two arm portions 43 of the receiving member 40.

The receiving member 40 of the present invention is suitable for holding the columnar laser sights of various dimensions. In the process of securing the laser sight 50 to the receiving member 40, the laser sight 50 is first inserted into the receiving through hole 41 of the receiving member 40 before two bolts 46 of one arm portion 43 are fastened. Thereafter, the remaining two bolts 46 of other arm portion 43 are fastened. As a result, the laser sight 50 is securely embraced by the receiving member 40 in its entirety.

Figure 5:
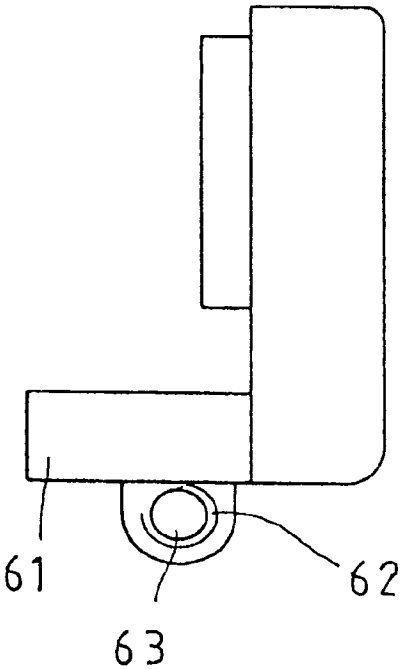
FIG. 5 shows a right view of the base cover as shown in FIG. 4.
Figure 4:
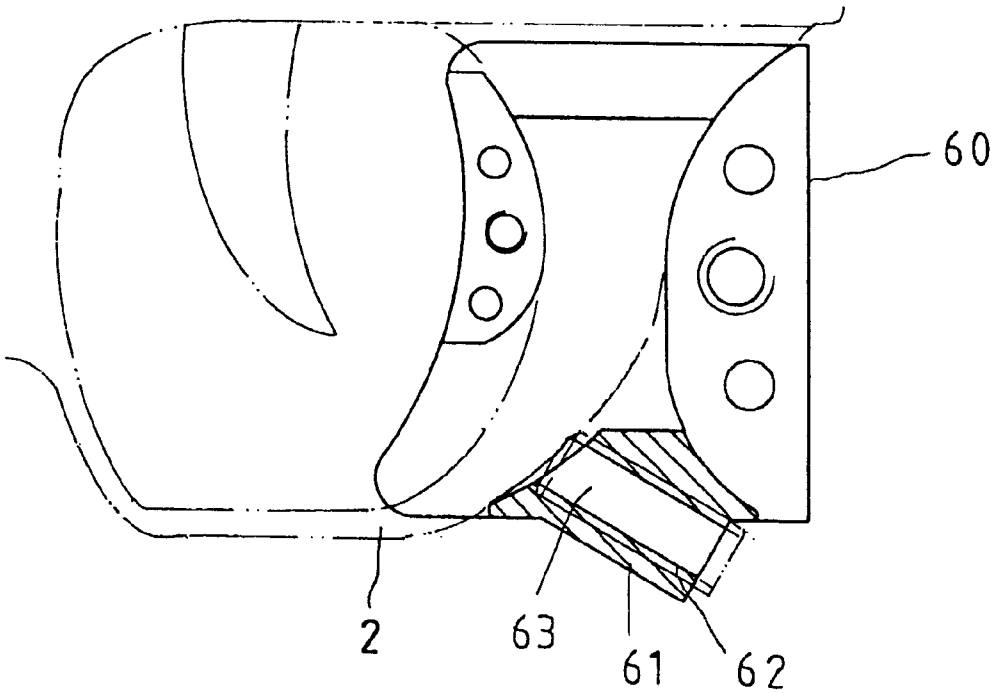
FIG. 4 shows a schematic view of a second shape of the base cover of the present invention.
Figure 6:
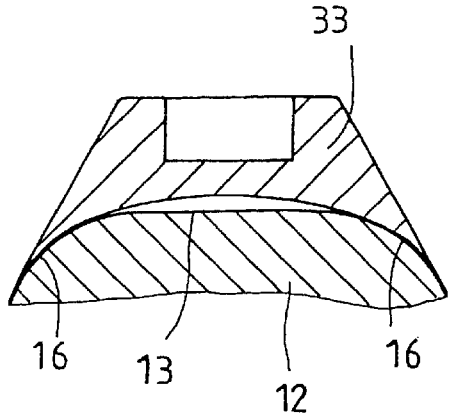
FIG. 6 shows a sectional view taken along the direction indicated by a line 6—6 as shown in FIG. 3.

As shown in FIGS. 4 and 5, the present invention is provided with a base cover 60 which is shaped to adapt to a pistol trigger guard 2 of an arcuate construction. The base cover 60 is provided at the lower side with a protruded portion 61 of a predetermined length and having a threaded hole 62 extending along the longitudinal direction of the protruded portion 61. The base cover 60 is further provided with a bolt 63, which is engaged with the threaded hole 62 for tightening the pistol trigger guard 2.

It must be noted here that the fastening of the base 10 with the L-shaped rod 30 of the present invention may be attained by an arcuate tenon and an arcuate mortise. The base 10 may be provided with the arcuate tenon or mortise, whereas the L-shaped rod 30 may be provided with the arcuate mortise or tenon. The arcuate tenon has a curvature radius slightly greater than a curvature radius of the arcuate mortise. As a result, the arcuate tenon and the arcuate mortise are intimately joined together when they are fastened by two bolts 39.

Figure 7:
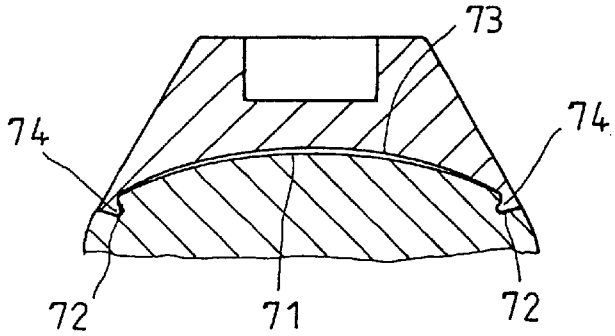
FIG. 7 is similar to FIG. 6 to show that the base and the L-shaped rod are fastened together in another form.

As shown in FIG. 7, another preferred embodiment of the present invention has an arcuate tenon 71 which is provided in two sides thereof with a recess 72, and an arcuate mortise 73 which is provided in two sides thereof with a projection 74 corresponding to the recess 72. The base and the L-shaped rod are fastened together such that the tenon 71 is received in the mortise 73, and that the two projections 74 are received in the two recesses 72.

Figure 8:
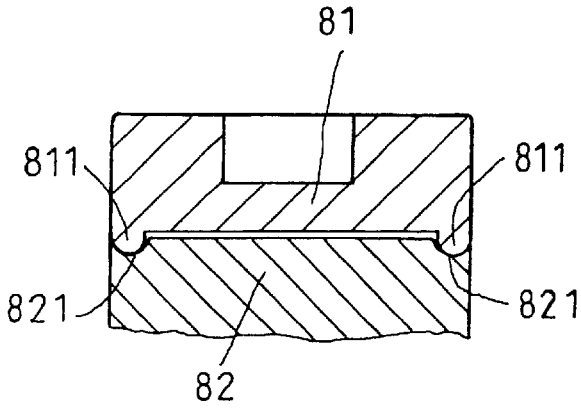
FIG. 8 is similar to FIG. 6 to show that the base and the L-shaped rod are fastened together in another form.

As shown in FIG. 8, the base and the L-shaped rod of the present invention may be fastened together in another form. The base has a fastening portion 81, whereas the L-shaped rod has a fastening portion 82. Both fastening portions 81 and 82 are of a planar construction. The fastening portion 81 is provided in two sides thereof with an arcuate protuberance 811, whereas the fastening portion 82 is provided in two sides thereof with an arcuate blind hole 821 corresponding to the protuberance 811. The base and the L-shape rod are fastened together by the two arcuate protuberances 811 which are received in the two arcuate blind holes 821.

The present invention combines the advantages of the U.S. Pat. Nos. 5,282,594 and 5,758,448. The present invention is capable of automatic fastening with precision so as to ensure the stability at the time when the pistol is fired. The present invention has an L-shaped rod which is provided with the suspension arm having two long holes to enable the L-shaped rod to be adjusted up and down to be in an intimate contact with the barrel to prevent the suspension arm of the L-shaped rod from swaying.

What is claimed is:

1. A device for mounting a pistol laser sight, said device comprising:

a base having a retaining slot of a depth for disposing a pistol trigger guard, said base provided with a first fastening portion facing a pistol muzzle and having an arcuate surface;

a base cover fastened with said base by butt joint for sealing off said retaining slot;

an L-shaped rod having a fixed arm and a suspension arm, said fixed arm being provided with a second fastening portion complementary in shape to said first fastening portion of said base whereby said second fastening portion is adjustably fastened with said first fastening portion by butt joint; and a receiving member having a receiving through hole, said receiving through hole being provided in a wall thereof with a notch extending along a longitudinal direction of said receiving through hole, said receiving member further having two arm portions opposite to each other and extending outward from two longitudinal sides of said notch, said receiving member being fastened with said L-shaped rod such that said suspension arm of said L-shaped rod is fastened between said two arm portions of said receiving member whereby said receiving through hole of said receiving member is used to hold the pistol laser sight;

wherein said fixed arm of said L-shaped rod is provided in one side thereof with a padding piece fastening thereto by fastened bolts.

2. The device as defined in claim 1, wherein said first fastening portion of said base is provided with a tenon; wherein said second fastening portion of said L-shaped rod is provided with a mortise corresponding to said tenon.

3. The device as defined in claim 2, wherein said first fastening portion is provided with a planar surface whereby said planar surface is provided in two sides with an arcuate surface.

4. The device as defined in claim 1, wherein said fixed arm of said L-shaped rod is provided with two long holes extending along the longitudinal direction of said fixed arm; and wherein said L-shaped rod is adjustably fastened with said base by a plurality of fastening bolts whereby said fastening bolts are received in said two long holes; and said base and L-shaped rod are fastened by said fastening bolts which are received through holes of said padding piece.

5. The device as defined in claim 4, wherein said first fastening portion of said base is provided with a plurality of threaded holes and adjusting screws engaged with said threaded hole; and wherein said fastening bolts are engaged with said threaded holes of said base.

6. The device as defined in claim 4, wherein said suspension arm of said L-shaped rod is provided in a top surface thereof with a depression whereby said depression becomes progressively deeper in the direction toward said fixed arm, so as to enable said depression to fit securely with the underside of a pistol barrel.

7. The device as defined in claim 1, wherein said receiving member is fastened with said suspension arm of said L-shaped rod by a plurality of bolts whereby said bolts are fastened onto said suspension arm through said two arm portions of said receiving member.

8. The device as defined in claim 1, wherein said base cover is provided in a lower side with a threaded hole, and a bolt which is engaged with said threaded hole for tightening a pistol trigger guard of an arcuate construction.

9. The device as defined in claim 1, wherein said retaining slot of said base is provided with a plurality of pads for adjusting the depth of said retaining slot.

10. The device as defined in claim 1, wherein said fastening portion of said base is an arcuate mortise; wherein said fastening portion of said L-shaped rod is an arcuate tenon greater in curvature radius than said mortise.

11. The device as defined in claim 1, wherein said fastening portions of said base and said L-shaped rod are of an arcuate construction, with one of said arcuate fastening portions being provided in two sides thereof with a recess or projection, and with other one of said arcuate fastening portions being provided in two sides thereof with a projection or recess corresponding to and engage able with said recess or projection.

12. The device as defined in claim 1, wherein one of said fastening portions of said base and said L-shaped rod is provided in two sides with an arcuate protuberance or blind hole, with other one of said two fastening portions being provided in two sides with an arcuate blind hole or protuberance engage able with said arcuate protuberance or blind hole.

* * * * *